US005783347A

United States Patent [19]

Ikami

[11] Patent Number: 5,783,347

[45] Date of Patent: Jul. 21, 1998

[54] POSITIVELY CHARGEABLE SINGLE-COMPONENT DEVELOPER AND IMAGE-FORMING APPARATUS FOR USING THE SAME

[75] Inventor: Jun Ikami, Nagoya, Japan

[73] Assignee: Brother Kogyo Kabushiki Kaisha, Nagoya, Japan

[21] Appl. No.: 872,184

[22] Filed: Jun. 10, 1997

[30] Foreign Application Priority Data

Jun. 27, 1996 [JP] Japan ..... 8-167644

[51] Int. Cl.[6] ..... G03G 9/097; G03G 15/08

[52] U.S. Cl. ..... 430/110; 430/411; 430/903; 399/252; 399/279

[58] Field of Search ..... 430/110, 111, 430/903; 399/252, 279

[56] References Cited

U.S. PATENT DOCUMENTS

| | | | |
|---|---|---|---|
| 5,084,369 | 1/1992 | Tanaka et al. | 430/110 |
| 5,514,409 | 5/1996 | Kawata et al. | 430/106.6 |
| 5,552,814 | 9/1996 | Maeda et al. | 347/55 |

FOREIGN PATENT DOCUMENTS

| | | |
|---|---|---|
| A-4-10430 | 1/1992 | Japan . |
| A-6-155798 | 6/1994 | Japan . |
| A-7-73918 | 3/1995 | Japan . |

*Primary Examiner*—Roland Martin
*Attorney, Agent, or Firm*—Oliff & Berridge, PLC

[57] ABSTRACT

A positively chargeable single-component developer for visualizing electrostatic latent images comprises a binding resin having an acid value of 1.5 to 10 (KOH mg/g), a colorant, and an additive such as polyfluoroethylene fine powder having an electron attractive group. The additive is added in an amount of 0.05 part by weight to 2 parts by weight with respect to 100 parts by weight of the positively chargeable single-component developer. The acid value of the binding resin may be adjusted by mixing two or more resins having different acid values. The developer prevents a surface of a photosensitive member from decrease in electric potential which would be otherwise caused by electrons released when toner particles and the photosensitive member are frictionally charged. Accordingly, the developer makes it possible to provide good image quality with less fog and with a dense density.

20 Claims, 6 Drawing Sheets

Negatively charging two-layer structure

Positively charging single-layer structure

POSITIVELY CHARGEABLE SINGLE-COMPONENT DEVELOPER AND IMAGE-FORMING APPARATUS FOR USING THE SAME

FIELD OF THE INVENTION

The present invention relates to a positively chargeable single-component developer which is principally used for image-forming apparatuses such as printers, facsimiles, copying machines, and plotters. The present invention also relates to an image-forming apparatus for using the developer.

DESCRIPTION OF THE RELATED ART

The electrophotographic system, which has been hitherto used in order to visualize an electrostatic latent image formed on a photosensitive member, includes the following steps. Namely, an electrostatic latent image developer, which contains colored particles called toner, is allowed to approach or contact with a surface of the photosensitive member on which the electrostatic latent image is formed. Toner particles, which are charged in the electrostatic latent image developer, are allowed to adhere to the surface of the photosensitive member to form a pseudo-image corresponding to the electrostatic latent image so that the electrostatic latent image is visualized (this process is referred to "development"). The toner image on the photosensitive member is transferred to an image-recording medium such as paper. In general, the electrophotographic system is roughly classified into the single-component development system and the two-component development system, depending on the development system used therein.

The two-component development system has been hitherto most frequently used for copying machines or the like. In this system, development is performed by using an electrostatic latent image developer comprising two components in total, i.e., a toner composed of colored particles, and a magnetic carrier for efficiently charging the toner up to a saturated value thereof. The two-component development system makes it possible to supply charged toner particles in a stable manner against any change in environment.

However, in the case of the two-component development system as described above, the charge amount of toner particles is affected by the mixing ratio of the magnetic carrier and the toner, which also exerts an influence on the image quality. Therefore, in order to maintain a constant mixing ratio, the system requires a complicated control technique involving, for example, a means for detecting the toner amount. As a result, it is difficult to miniaturize and simplify the apparatus.

On the contrary, the single-component development system uses only a toner as an electrostatic latent image developer. Therefore, it is easy to miniaturize and simplify the apparatus. Recently, the single-component development system has been vigorously researched and developed.

The single-component development system includes two types based on the use of a magnetic toner or a non-magnetic toner. In any type, the system is constructed such that a thin developer layer is formed on a toner carrier for conveying toner particles to an electrostatic latent image on a photosensitive member.

Specifically, the printing operation will be explained in which a positively chargeable toner is especially used in the non-magnetic single-component system.

The surface of the photosensitive member is charged by using a charger such as a corotron. The electric potential of exposed portions is lowered by irradiating the photosensitive member with a light beam such as a laser beam, in accordance with image information. Thus, an electrostatic latent image is formed.

An electric potential (development bias), which is lower than an electric potential of unexposed portions on the photosensitive member and which is higher than an electric potential of exposed portions on the photosensitive member, is applied to a surface of a developing roller which carries toner particles on its surface and conveys the toner particles to the photosensitive member.

For example, when unexposed portions have an electric potential of about +700 V, and exposed portions have an electric potential of about +100 V, then a development bias of about +400 V is applied to the surface of the developing roller.

The toner particles on the developing roller are formed into a layer having a desired thin thickness by means of a plate-shaped blade composed of metal or resin, and the toner particles are charged by friction. The electrostatic latent image is developed by allowing the toner thin layer to contact with the photosensitive member which carries the electrostatic latent image on its surface.

In the foregoing instance, when the toner particles charged to have positive polarity contact with the photosensitive member, the electrostatic force allows the toner particles to move from the developing roller at +400 V to the exposed portions on the photosensitive member at +100 V. On the unexposed portions on the photosensitive member corresponding to the white background of the formed image, the toner particles undergo the electrostatic force directing from the unexposed portions on the photosensitive member at +700 V to the surface of the developing roller at +400 V. Therefore, the toner particles are controlled so that they do not move from the developing roller to the unexposed portions on the photosensitive member. Thus, the electrostatic latent image on the photosensitive member is developed.

An image-forming apparatus based on the toner flow direct control system has been hitherto known, as disclosed, for example, in U.S. Pat. No. 5,552,814 corresponding to Japanese Laid-Open Patent Publication No. 6-155798. The image-forming apparatus of this type is constructed as follows. Namely, a driving signal corresponding to an image signal is applied to an aperture electrode device having a plurality of small holes (hereinafter referred to as "apertures") to control the passage of toner particles through the apertures so that toner particles having passed through the apertures are used to obtain an image on an image-recording medium such as printing paper.

As shown in FIG. 7, such an image-forming apparatus comprises an aperture electrode device 201 arranged between a toner-carrying roller 214 and an image-recording medium 220, and a back electrode roller 222 provided on a back surface of the image-recording medium 220.

The aperture electrode device 201 of the image-forming apparatus 200 includes at least one row of a plurality of apertures 206 formed through an insulative sheet 202 made of polyimide having a thickness of 25 to 100 μm, each of the apertures 206 having a circular shape with a diameter of 30 to 250 μm or a shape similar thereto having an aperture area equivalent to that of the circular shape. The aperture electrode device 201 further comprises control electrodes 204 formed around the apertures 206, each of the control electrodes 206 being composed of a copper film having a thickness of 0.1 to 15 μm and a width of 10 to 50 μm.

The aperture electrode device 201 is arranged so that its surface on a side on which the control electrodes 204 are provided is opposed to the image-recording medium 220. In the image-forming apparatus 200, a control voltage corresponding to an image signal is applied to the control electrodes 204 from a control voltage-applying circuit 208 to control the flow of toner particles 216 carried on the toner-carrying roller 214. Thus, an image is formed on the image-recording medium 220.

A supply roller 212 and a toner layer-regulating blade 218 are used as means for loading the toner on the toner-carrying roller 214.

The supply roller 212 and the toner-carrying roller 214 are parallel to one another, and they are arranged so that generators of their cylindrical surfaces contact with each other. The supply roller 212 and the toner-carrying roller 214 are rotated in an identical direction or in mutually opposite directions.

A part of the supply roller 212 is immersed in a mass of toner 216 which is stored in a toner case 211. At this section, the toner particles 216 is loaded on the surface and the surface layer portion of the supply roller 212. The toner particles 216 are rubbed between the toner-carrying roller 214 and the supply roller 212, and thus the toner particles 216 are frictionally charged and loaded on the toner-carrying roller 214.

The toner-carrying roller 214 is allowed to forcedly contact with one end of the toner layer-regulating blade 218. Thus, the toner layer, which is loaded on the toner-carrying roller 214 as described above, is smoothed to have a desired supply density and a desired charge amount. The charge amount of the toner particles 216 are additionally operated and adjusted in some cases by manipulating the conductivity of the toner layer-regulating blade 218 or by connecting it to the ground or an arbitrary power source unit.

As described above, the thin layer of the toner particles 216 having the desired charge amount and the desired density is formed on the toner-carrying roller 214, and it is supplied to the vicinity of the apertures 206 of the aperture electrode device 201. The toner particles 216 adhere to the toner-carrying roller 214 by a certain force exerted by the action of the electrostatic mirror force caused by the charge possessed by the particles and the adhesive force such as the van der Waals force. It is difficult to allow the toner particles to flow only by applying an electrostatic field against the foregoing forces. Accordingly, the toner particles 216 carried on the toner-carrying roller 214 are allowed to contact with the surface of the aperture electrode device 201 opposed to the toner-carrying roller 214, especially with the surface in the vicinity of the row of the apertures 206 so that the toner particles 216 are allowed to roll on the toner-carrying roller 214. It is assumed that when the sum of such a mechanical function and the electrostatic field exceeds the sum of the mirror force and the adhesive force, the toner particles 216 are released from the toner-carrying roller 214, and they pass through the apertures 206.

The supply roller 212, the toner-carrying roller 214, and the toner layer-regulating blade 218 described above are arranged in exactly the same manner as those of the known electrophotographic non-magnetic single-component development system.

However, the electrostatic latent image-developing system as described above suffers the following problem. Namely, toner particles, which are insufficiently charged by the blade, contact with the photosensitive member at a nip portion (contact portion between the developing roller and the photosensitive member). As a result, such toner particles are frictionally charged again at this portion, and an electron flow occurs during this process. The electron flow disturbs the electrostatic latent image on the photosensitive member.

For example, when a positively chargeable toner is used, toner particles, which are insufficiently charged by the blade, are positively charged by the contact with the photosensitive member, and electrons are released during this process.

Those generally adopted as a photosensitive member used for the negative charge development system are arranged as shown in FIG. 4 in which the photosensitive member is separated into a charge-generating layer 52 and a charge (positive hole)-transporting layer 50. On the other hand, those adopted as a photosensitive member used for the positive charge development system have a single-layer structure based on the use of a mixed layer 54 in which the charge-generating layer is not separated from the charge-transporting layer as shown in FIG. 5. Especially, the photosensitive member having such a single-layer structure is often used for image-forming apparatuses such as cheap printers. Therefore, when the photosensitive member having the single-layer structure for the positive charge development system is used, a problem arises in that the surface potential of the photosensitive member is changed due to direct movement of electrons between the toner particles and the charge-generating substance contained in the photosensitive member.

For example, as shown in FIG. 6, it is assumed that a developing roller 116, which carries toner particles 126 on its surface, contacts with a photosensitive member 110 on which unexposed portions having a surface potential of about +700 V and exposed portions having a surface potential of about +100 V are formed. The toner particles 126, which have a charge amount sufficient to perform development but which are not charged up to a saturated value thereof, are frictionally charged by the aid of the photosensitive member 110, and thus electrons $e^-$ are released from the toner particles 126. The electrons $e^-$ are attracted by an electrostatic field in a direction from the developing roller 116 at about +400 V to the unexposed portion on the photosensitive member 110 having the surface potential of about +700 V. The electrons $e^-$ bind to the surface charge of the unexposed portion again. As a result, the electric potential is lowered from +700 V to, for example, about +500 V.

The difference between the surface potential of the photosensitive member 110 and the surface potential of the developing roller 116 at the unexposed portion determines the electric field strength to give the electrostatic force to the toner particles 126 in the direction toward the developing roller 116 so that the toner particles 126 do not adhere to the photosensitive member 110. When the surface potential of the photosensitive member 110 is not lowered, the difference is (+700)−(+400)=+300 V. However, when the surface potential of the photosensitive member 110 is lowered as described above, the difference is (+500)−(+400)=+100 V. Namely, the electric field strength for the toner particles 126 to avoid adhesion to the unexposed portion is weakened. For this reason, some toner particles make adhesion, and such toner particles 126 are transferred to the paper, resulting in occurrence of a so-called fog phenomenon.

As for the composition of the toner, in general, those often used as a substance to adjust the charge amount of the positively chargeable toner include charge control agents based on quaternary ammonium salt, nigrosine, and triphenylmethane. However, the charge control agents based on nigrosine and triphenylmethane have strong force to be positively charged, while they are slow in charge start up, as compared with the charge control agents based on quaternary ammonium salt. Therefore, the nigrosine-based charge controlling agents and the triphenylmethane-based charge controlling agents fail to arrive at the saturated charge amount by only the frictional charging by the aid of the blade as described above. They are frictionally charged again at the nip portion between the photosensitive member and the developing roller, resulting in the problem of fog caused by the decrease in surface potential of the photosensitive member as described above. However, regardless of the presence of the foregoing problem, the nigrosine-based charge controlling agents and the triphenylmethane-based charge controlling agents generate a charge amount of a magnitude suitable to develop the electrostatic latent image, and they are extremely convenient to easily obtain a high quality image having a high density. For this reason, the nigrosine-based charge controlling agents and the triphenylmethane-based charge controlling agents are frequently used as compared with the quaternary ammonium salt-based charge control agents which provide a relatively small charge amount.

Especially, when the developing roller and the photosensitive member are rotated in an identical direction, a relation (so-called counter contact) is given, in which the photosensitive member 110 and the developing roller 116 are moved in mutually opposite directions at the nip portion. In such a state, a toner pool P tends to appear as shown in FIG. 6. A large amount of insufficiently charged toner particles as described above are present in the toner pool P. When the toner pool P appears, then the time of contact between the photosensitive member 110 and the toner particles 126 is prolonged, the possibility of occurrence of frictional charge is increased, and the foregoing problem becomes more serious.

As described above, the problem of disturbance of the electrostatic latent image, which is caused by the recharging of the insufficiently charged toner particles on the surface of the photosensitive member, arises especially conspicuously when the photosensitive member and the developing roller are subjected to the counter contact. For this reason, explanation has been made on such a condition with reference to FIG. 6. However, this phenomenon also occurs in a state of so-called "mated rotation" in which the photosensitive member and the developing roller are rotated in opposite directions, and they are moved in an identical direction at the contact portion between the both. Especially, when the circumferential velocity ratio differs between the photosensitive member and the developing roller, the problem is conspicuous because of occurrence of deviational friction.

The image-forming apparatus based on the toner flow direct control system has been described as the image-forming apparatus based on another system. In this case, the problem caused by the recharging of the insufficiently charged toner particles also occurs in the same manner as described above.

Namely, with reference to FIG. 7, insufficiently charged toner particles 216 are positively charged by friction caused by the contact between the toner-carrying roller 214 and the insulative sheet 202 of the aperture electrode device 201. Electrons, which are discharged from the toner particles 216 due to the positive charge of the toner particles 216, are accumulated as negative charge on the surface of the insulative sheet 202. As a result, the surface potential thereof arrives at about −1000 V or more. The surface potential allows the positively charged toner particles 216 to make tight adhesion by the electrostatic force. The adhered toner particles further undergo friction, and they are melted and affixed by heat. Consequently, normal toner particles 216 are prevented from being conveyed to the apertures 206, resulting in serious problems such as faint or patchy printed images and clogging of the apertures 206 in some excessive cases.

SUMMARY OF THE INVENTION

The present invention has been made in order to solve the foregoing problems involved in the conventional techniques, an object of which is to provide a positively chargeable single-component developer which makes it possible to prevent a surface of a photosensitive member from decrease in electric potential caused by electrons released when toner particles and the photosensitive member are frictionally charged, and thereby form an image having a sufficient printing density with neither fog nor faint print, and an image-forming apparatus based on the use of the developer.

According to a first aspect of the present invention, there is provided a positively chargeable single-component developer for visualizing electrostatic latent images, comprising:

a binding resin having an acid value of about 1.5 to about 10 (KOH mg/g);

a colorant; and an additive having an electron attractive group, wherein;

the additive is added in an amount of about 0.05 part by weight to about 2 parts by weight with respect to 100 parts by weight of the positively chargeable single-component developer.

In the developer according to the present invention, the electron-attracting force of the binding resin is optimized by adjusting the acid value of the binding resin to be about 1.5 (KOH mg/g) to about 10 (KOH mg/g). Namely, the developer according to the present invention suppresses insufficiently charged developer particles which would otherwise generate electrons by the aid of frictional charging, for example, at the nip portion between a developing roller and a photosensitive member. If the acid value is less than about 1.5 (KOH mg/g), the effect to suppress the electron generation from the binding resin is not effective. As a result, the surface potential of the photosensitive member is lowered, and the fog appears. If the acid value exceeds about 10 (KOH mg/g), the electron-attracting force of the developer is excessively strong. As a result, the developer is negatively charged, and thus the fog appears.

The acid value of the binding resin can be adjusted by performing one of or both of introduction of a polar group exhibiting acidity into the resin and substitution of hydrogen of an acidic group with a substituent. When the binding resin has a low acid value, the acid value can be increased by incorporating, into the binding resin, the polar group such as carboxyl group which exhibits acidity. When the binding resin has a high acid value, the acid value of the binding resin can be decreased by substituting hydrogen of terminal hydroxyl group of the acidic group such as carboxyl group in the binding resin, with an arbitrary substituent such as alkyl group by means of, for example, ester linkage.

In a preferred embodiment, the binding resin is a mixed resin composed of a first resin having a relatively low acid value and a second resin having a relatively high acid value. The acid value of the binding resin can be adjusted to be about 1.5 to about 10 (KOH mg/g) by mixing the first and second resins. In this embodiment, the second resin having the relatively high acid value efficiently captures electrons released from the positively chargeable single-component developer. The charge amount of the positively chargeable single-component developer is adjusted by amounts of the first and second resins to be mixed. For example, the binding resin may be a mixed resin composed of a polystyrene binder resin and a polyester binder resin.

The positively chargeable single-component developer of the present invention may further comprise at least one of a triphenylmethane compound and a nigrosine compound so that the charge amount of the positively chargeable single-component developer is set to be comparatively large. Accordingly, the positively chargeable single-component developer can be charged in a stable manner.

According to a second aspect of the present invention, there is provided an image-forming apparatus comprising:

an electrostatic latent image carrier for carrying an electrostatic latent image on its surface; and a developer-conveying member arranged in contact with the latent image carrier, for conveying a developer to the electrostatic latent image on the electrostatic latent image carrier, wherein;

the developer is a positively chargeable single-component developer comprising a binding resin having an acid value of about 1.5 to about 10 (KOH mg/g), a colorant, and an additive having an electron attractive group, and the additive is added in an amount of about 0.05 part by weight to about 2 parts by weight with respect to 100 parts by weight of the positively chargeable single-component developer.

In the conventional image-forming apparatus, insufficiently charged developer particles are charged at a contact position between the electrostatic latent image carrier such as a photosensitive member and the developer-conveying member such as a developing roller, and thus electrons are generated from the developer particles. As a result, fog or the like occurs in a developed image due to the influence of the generated electrons. The image-forming apparatus of the present invention uses the positively chargeable single-component developer according to the present invention. Therefore, it is possible to avoid occurrence of fog or the like, and provide an image having good image quality.

A nip is formed by the contact between a photosensitive member-equipped roller as the electrostatic latent image carrier and a developing roller as the developer-conveying member. The image-forming apparatus of the present invention can provide an image having good image quality even when the rollers are moved in opposite directions at the nip, or when the rollers are moved in an identical direction at the nip, and the rollers are moved in mutually different velocities.

The image-forming apparatus of the present invention may be embodied as an optical printer such as an optical printer based on the toner flow direct control system, and as an image-forming apparatus for forming an electrostatic latent image by allowing ion to flow toward an electrostatic latent image carrier by using an ion flow control means.

DETAILED DESCRIPTION OF THE PREFERRED EMBODIMENTS

Figure 1:
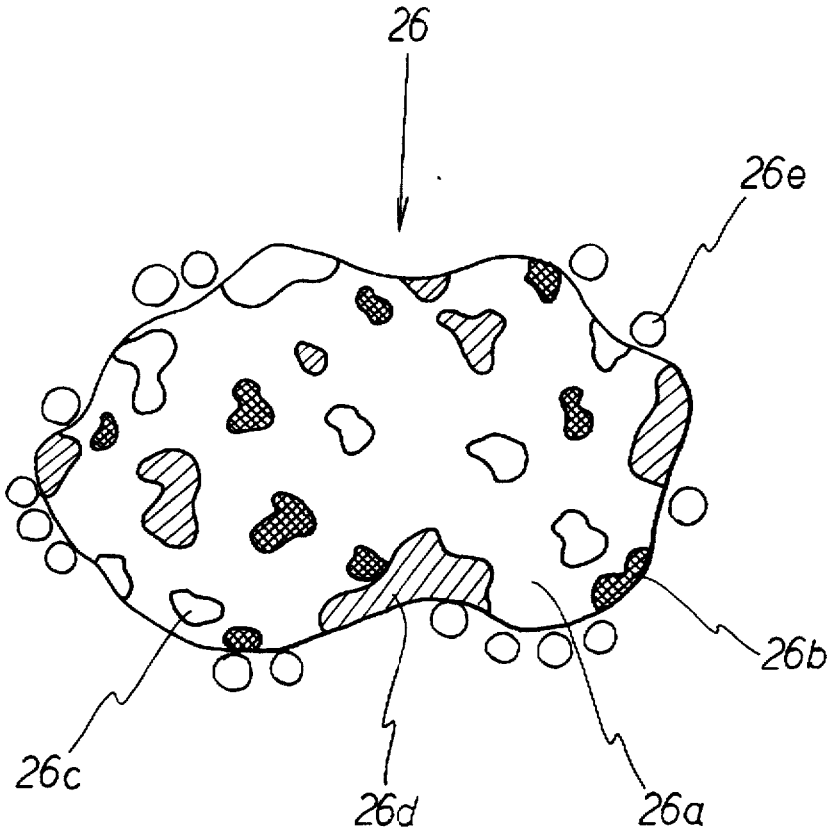
FIG. 1 shows a cross-sectional view schematically illustrating a structure of a positively chargeable single-component developer of the present invention.

The positively chargeable single-component developer according to the present invention will be explained below on the basis of embodiments which specify the present invention.

At first, an embodiment of the image-forming apparatus based on the use of the positively chargeable single-component developer according to the present invention will be explained with reference to FIG. 2.

The image-forming apparatus 2 comprises at least a detachable process unit 34 having functions to effect storage, supply, charging, and development of a toner 26 as the positively chargeable single-component developer, and a fixed drum unit 32 having functions to effect development and transfer.

Specifically, the drum unit 32 comprises at least a photosensitive member 10 as an electrostatic latent image carrier produced by applying a photoconductive layer to a conductive cylinder made of aluminum; a charger or an electrifier 12 arranged around the photosensitive member 10, for giving a surface potential to an entire surface of the photosensitive member 10; an exposure unit 14 for forming an electrostatic latent image on the surface of the photosensitive member 10 by irradiating the surface of the photosensitive member 10 having passed over the charger 12 with light while performing scanning in accordance with image information; a transfer roller 20 for transferring toner particles 26 developed on the photosensitive member 10 to a recording medium 18 such as paper; and a cleaning roller 22 for removing toner particles 26 remaining on the photosensitive member 10 without being transferred by the transfer roller 20.

The process unit 34 comprises at least a developing roller 16 as a developer-conveying member for carrying toner particles 26 and conveying the toner particles 26 to the electrostatic latent image on the photosensitive member 10; a blade 4 for regulating the toner particles 26 on the developing roller 16 to form a uniform thin layer and positively charging the toner particles 26; a supply roller 8 for supplying the toner particles 26 to the developing roller 16; and an agitator 6 for agitating the toner particles 26 stored in a toner-storing section 28 to maintain a good fluidized state.

The drum unit 32 and the process unit 34 contact with each other at a position between the photosensitive member 10 and the developing roller 16 by the aid of a pressing force exerted by an extension spring 30.

The image-forming apparatus 2 further comprises a thermal fixing unit 24 (composed of a pair of rollers containing a heater) for fixing a toner image on the recording medium 18 by means of melting with heat.

The toner 26 according to this embodiment is accommodated in the toner-storing section 28 of the process unit 34. The toner 26 is supplied to the surface of the supply roller 8 while being agitated by the agitator 6. The toner 26 is supplied from the surface of the supply roller 8 to the surface of the developing roller 16 in accordance with rotational motion of the supply roller 8 and the developing roller 16 in directions indicated by arrows. After that, the toner 26 is formed into a thin layer by the aid of the blade 4, and it is positively charged.

An unillustrated high voltage power source is connected to the charger 12. A surface potential of about +700 V is formed on the photosensitive member 10 by using the charger 12.

The charger 12 may have any form including those which contact with the photosensitive member 10 and those which do not contact with the photosensitive member 10. Those usable as the charger 12 include, for example, a corotron and a scorotron for giving a predetermined surface potential to the photosensitive member 10 by means of corona discharge, as well as semiconductive members such as brushes, blades, and rollers for giving a surface potential to the photosensitive member 10 by making contact therewith.

The photosensitive member 10, to which the surface potential has been given by the charger 12, is irradiated with light coming from the exposure unit 14 in accordance with image information converted into electric signals, while performing scanning in a direction of the generator of the cylindrical photosensitive member 10. The surface potential of portions exposed with light is lowered to about +100 V by the aid of the action of the photoconductive layer formed on the photosensitive member 10. However, the surface potential of unexposed portions is maintained at about +700 V. Accordingly, an image depicted by a surface potential distribution, i.e., an electrostatic latent image is formed on the photosensitive member 10.

Those usable as the exposure unit 14 include, for example, a laser scanner based on a combination of an LED light source, a scanning means such as a polygon mirror and a galvanomirror, and a correction lens, as well as an LED array including a plurality of aligned LED'S.

The photosensitive member 10 and the developing roller 16 are rotated in directions indicated by arrows. Therefore, the direction of movement of each of them is opposite to one another at the portion of mutual contact, i.e., at the so-called nip portion. Namely, the relation between them is counter contact.

The toner 26 is formed into a thin layer by the aid of the blade 4, and it is positively charged. The thin layer of the toner 26 is conveyed by the developing roller 16 to which a development bias of +400 V is applied. The thin layer of the toner 26 contacts with the photosensitive member 10 on which the electrostatic latent image is carried. The toner 26 adheres to only the portions on the photosensitive member 10 in which the surface potential has been lowered to +100 V by the light irradiation. The toner 26 does not adhere to the unexposed portions in which the surface potential remains at +700 V.

The image of the toner 26 thus formed on the photosensitive member 10 is transferred onto the recording medium 18 such as paper by using the transfer roller 20 which is subjected to constant current control at about 3 microamperes and in which the polarity is controlled to be negative. The toner 26 is fixed on the recording medium 18 by the aid of the thermal fixing unit 24. Thus, an objective recording image can be obtained. On the other hand, the toner 26, which remains on the photosensitive member 10 without being transferred to the recording medium 18, is recovered by the cleaning roller 22 to which a voltage of −400 V is applied.

Next, detailed explanation will be made for the toner 26 used for the image-forming apparatus 2 constructed as described above. The toner 26 of this embodiment is prepared as a positively chargeable non-magnetic single-component developer.

As shown in FIG. 1, the toner 26 basically comprises a binding resin **26*a*, a colorant 26*b*, a parting agent 26*c*, a charge control agent 26*d*, and an external additive 26*e***.

The binding resin **26*a*** functions as a binder, which occupies the greater part of the toner. Resins useable for the toner binder include polystyrene resins, polyacrylate resins, polymethacrylate resins, polyvinyl resins, polyester resins, polyethylene resins, polypropylene resins, polyvinyl chloride, polyether resins, polycarbonate resins, polycellulose resins, polyamide resins, and copolymers for forming the foregoing resins. Among them, those having an acid value of not less than about 1.5 (KOH mg/g) and not more than about 10 (KOH mg/g) are used.

In general, for example, polystyrene resins and acrylic resins exhibit good charging as the binder, and they are used for the positively chargeable developer. It has been considered that polyester resins are suitable for negatively chargeable developers. However, polyester resins can be also used as the binding resin for the positively chargeable developer by replacing, with a substituent such as alkyl group, hydrogen of hydroxyl group existing at the tip of carboxyl group existing at the end of the resin, or by manipulating alkyl group existing between ester bonds.

The colorant **26*b*** includes, for example, carbon blacks such as furnace black, Ketjen Black, lamp black, thermal black, and channel black. They may be used as a simple substance, or two or more of them may be used as a mixture. Those preferably used as the carbon black have a small specific surface area and a large oil absorption. Specifically, it is preferable to use those having a quotient of not more than 0.8 obtained by dividing the specific surface area (unit: $cm^2/mg$) by the oil absorption (unit: ml/100 g). Especially, it is preferable to use furnace black because it satisfies the foregoing condition.

Other colorants may be used, including, for example, black toners such as carbon black described above as well as nigrosine dyes, aniline dyes, mono-azo dyes, and dis-azo dyes; yellow toners such as mono-azo dyes, dis-azo dyes, diphenylamine dyes, and benzidine pigments; magenta toners such as azo dyes, anthraquinone dyes, rhodamine dyes, and quinacridone pigments; and cyan toners such as copper phthalocyanine pigments.

It is possible to mix and use, as the parting agent **26*c*, polyalkylene waxes or natural waxes. Specifically, those usable as the parting agent 26*c*** include, for example, polyethylene, polypropylene, carnauba wax, candelilla wax, and rice wax.

Those usable as the charge control agent **26*d* when the toner 26** is positively chargeable include, for example, nigrosine compounds, triphenylmethane compounds, quaternary ammonium salts, alkoxylated amine, and alkylamide.

Next, the external additive **26*e* will be explained. The external additive 26*e*, which is referred to in this embodiment, has an electron attractive group. Those usable as the electron attractive group include, for example, those containing a halogen compound associated with, for example, trifluoroethyl group and trichloroethyl group. Specifically, those usable as the external additive 26e** include, for example, polyfluoroethylene fine powder, polyfluorovinylidene fine powder, polychloroethylene fine powder, polychlorovinylidene fine powder, polybromoethylene fine powder, polybromovinylidene fine powder, and polyester fine powder.

When the toner 26 is frictionally charged by the surface of the photosensitive member 10, the external additive 26e attracts electrons which are released from the toner 26 to move toward the photosensitive member 10 in accordance with the difference between the surface potential of the unexposed portions of the photosensitive member 10 and the surface potential of the developing roller 16. Thus, the surface of the photosensitive member 10 can be prevented from the decrease in electric potential. However, if the external additive 26e is externally added in a small amount, no sufficient effect is obtained. On the other hand, if the external additive 26e is externally added in an excessive amount, oppositely charged toner particles may appear. Accordingly, it is necessary for the external additive 26e that the amount of its external addition is adjusted to be not less than about 0.05 part by weight and not more than about 2 parts by weight with respect to 100 part by weight of the powder prepared before the external addition.

Even when the polymer fine powders have an identical polymerization degree, they provide different effects depending on the amount of the substituent which exhibits the electron-attracting effect. For example, in the case of polytetrafluoroethylene and polyfluorovinylidene, polytetrafluoroethylene has four fluoro groups existing in the minimum unit of the polymer, while polyfluorovinylidene has two fluoro groups existing in the minimum unit of the polymer. Therefore, polyfluorovinylidene has a smaller electron-attracting effect than polytetrafluoroethylene. For this reason, it is necessary for polyfluorovinylidene to be externally added in a relatively large amount as compared with polytetrafluoroethylene.

Besides, fine powders appropriate to answer the purpose may be added as the external additive 26e in a necessary amount depending on various applications. For example, in some cases, hydrophobic silica fine powder is used as an agent to give fluidity in order to adjust fluidity of the toner 26. In other cases, aluminum fine powder is used as an abrading agent for abrading deposits on the blade 4 and the photosensitive member 10.

EXAMPLES

Next, the toner 26 according to the present invention will be explained with reference to several Examples and Comparative Examples. At first, when the toner 26 was produced, materials were used in the following blending ratio in the following steps.

Namely, the following materials in powder were mixed with 100 parts by weight of a binding resin to serve as a toner binder.

Charge control agent: 4 parts by weight
Carbon black (Mitsubish Chemical, #260): 5 parts by weight
Wax (Sanyo Chemical, Biscol 660 P): 5 parts by weight Carbon black, wax, and the charge control agent were dispersed in the binder resin while heating the materials by using a kneading extruder. The heated and kneaded materials were cooled, followed by coarse pulverization and fine pulverization by using a pulverizer such as a jet mill to prepare fine particles of an order of several μm. Particles having an excessively small particle diameter were removed by using an air classifier. Consequently, particles having a particle diameter of 3 to 20 μm were obtained. This step will be hereinafter simply expressed by using a term "granulate", and the prepared powder before being formed into a toner will be expressed as "toner powder precursor".

100 parts by weight of the toner powder precursor expressed by the foregoing composition was mixed with 1 part by weight of hydrophobic silica fine powder having a BET specific surface area of 300 $cm^2/mg$ together with fine powder having an electron attractive group to obtain a mixture which was agitated at 2000 rpm for 3 minutes by using Henschel mixer.

Toners 26 were produced in accordance with the foregoing steps, as those concerning Examples and Comparative Examples described later on. The steps, in which the toner powder precursor is externally added with the hydrophobic silica fine powder and the fine powder having the electron attractive group to finally produce the toner 26, will be hereinafter simply expressed by using a phrase "formed into a toner", if necessary.

Figure 2:
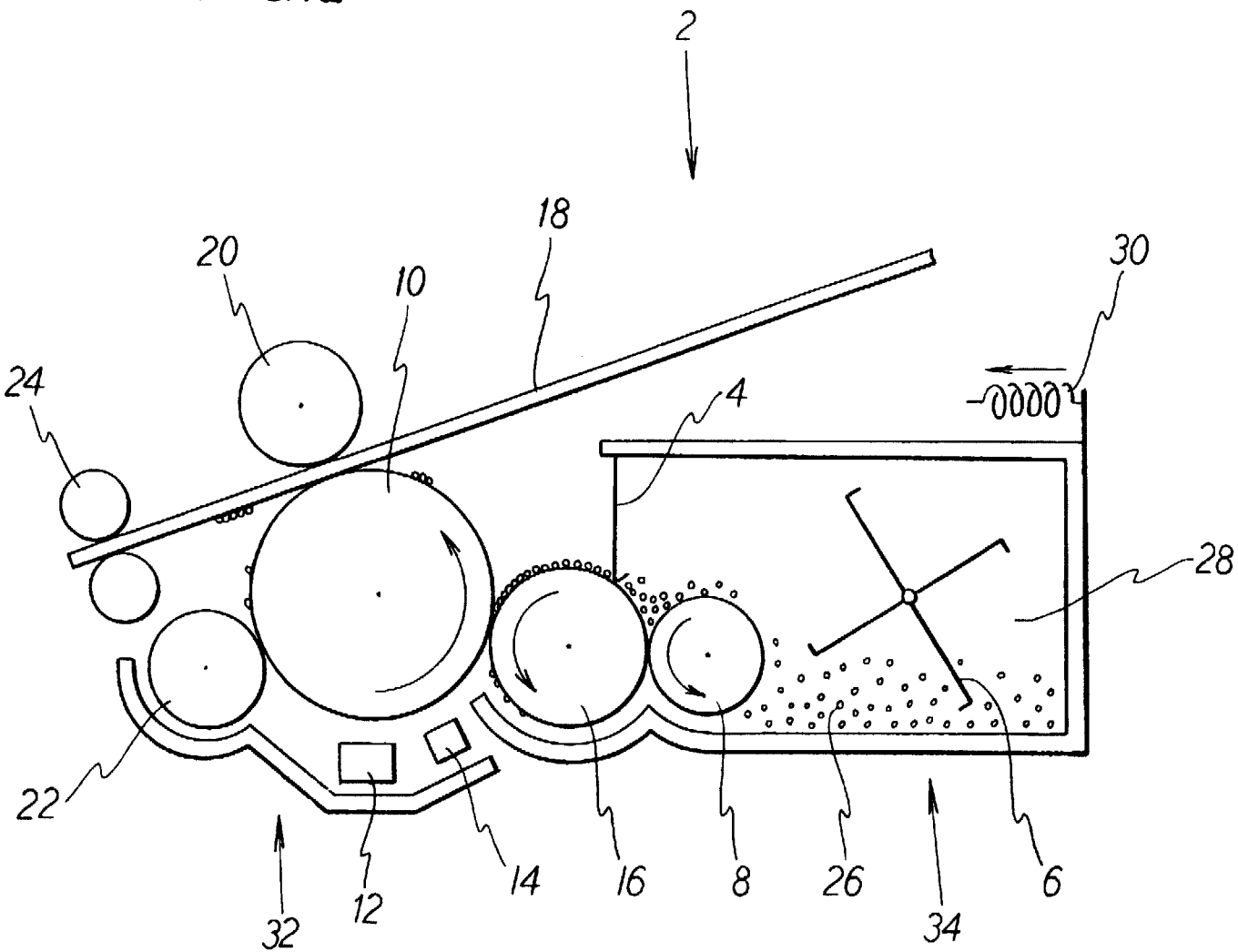
FIG. 2 shows a schematic illustration of an image-forming apparatus based on the use of the positively chargeable single-component developer of the present invention.

The image-forming apparatus 2 shown in FIG. 2 was filled with the toner 26 thus produced, and an image was outputted. The image was evaluated for those developed on the photosensitive member 10, not for those printed on the recording medium. At first, a strip of Scotch mending tape (produced by 3M) was stuck onto a white-printed background as an unexposed portion on the photosensitive member 10, and the tape was peeled off. Thus, toner particles, which were developed as fog on the photosensitive member 10, were transferred to an adhesive surface of the tape. Next, the whiteness or brightness of the tape onto which nothing was transferred, and the whiteness of the tape onto which the fog toner particles were transferred were measured by using REFLECT METER MODEL TC-6MC produced by Tokyo Denshyoku. A difference between the two whiteness values was determined. The degree of fog development was quantified in accordance with the magnitude of an obtained value of difference.

When the whiteness difference is within 6.0, fog development was not conspicuous even after transfer onto the recording medium. Accordingly, a permissible value of fog development was set to be within 6.0. A smaller difference in whiteness expressed a smaller degree of fog, while a larger difference in whiteness expressed a more serious situation of the degree of fog.

The surface potential of unexposed portions on the photosensitive member 10 (hereinafter referred to as "surface potential on the photosensitive member" for the purpose of simplification) was measured when respective toners were used. The change in the surface potential on the photosensitive member was investigated. The surface potential was measured by using model 344 produced by trek.

For reference, the surface potential was +700 V when the toner 26 did not contact with the photosensitive member 10 at all.

Example 1

A binder resin composed of a mixture of polystyrene and polyester having an acid value of 3.7 (KOH mg/g) was used as a binding resin, which was granulated together with a charge control agent based on nigrosine to prepare a toner powder precursor. 100 parts by weight of the toner powder precursor was formed into a toner together with 0.3 part by weight of polyfluorovinylidene fine powder and 1 part by weight of hydrophobic silica fine powder as external additives to evaluate image quality.

As a result, the difference in whiteness was 3.26, which was an extremely satisfactory value.

The surface potential on the photosensitive member was lowered, however, it was 650 V. The degree of decrease was not so serious. Accordingly, it was considered that appropriate development was performed, and an image of good quality was obtained.

Example 2

A binder resin composed of a mixture of polystyrene and polyester having an acid value of 3.7 (KOH mg/g) was used as a binding resin, which was granulated together with a charge control agent based on nigrosine to prepare a toner powder precursor. 100 parts by weight of the toner powder precursor was formed into a toner together with 0.3 part by weight of polytetrafluoroethylene fine powder and 1 part by weight of hydrophobic silica fine powder as external additives to evaluate image quality.

As a result, the difference in whiteness was 1.34, which was an extremely satisfactory value.

The surface potential on the photosensitive member was scarcely lowered. Accordingly, it was considered that appropriate development was performed, and an image of good quality was obtained.

Example 3

A binder resin composed of a mixture of polystyrene and polyester having an acid value of 10 (KOH mg/g) was used as a binding resin, which was granulated together with a charge control agent based on nigrosine to prepare a toner powder precursor. 100 parts by weight of the toner powder precursor was formed into a toner together with 0.3 part by weight of polytetrafluoroethylene fine powder and 1 part by weight of hydrophobic silica fine powder as external additives to evaluate image quality.

As a result, the difference in whiteness was 5.1, which was a value included in the permissible range.

The surface potential on the photosensitive member was scarcely lowered. However, it was considered that oppositely charged toner elements were increased due to the increase in acid value of the resin, which caused the increase in whiteness difference although the whiteness difference was the permissible range.

Example 4

A binder resin composed of a mixture of polystyrene and polyester having an acid value of 1.5 (KOH mg/g) was used as a binding resin, which was granulated together with a charge control agent based on nigrosine to prepare a toner powder precursor. 100 parts by weight of the toner powder precursor was formed into a toner together with 2 parts by weight of polytetrafluoroethylene fine powder and 1 part by weight of hydrophobic silica fine powder as external additives to evaluate image quality.

As a result, the difference in whiteness was 4.3, which was a satisfactory value.

The surface potential on the photosensitive member was lowered to be 630 V. However, it was considered that the surface potential on the photosensitive member was within the range in which appropriate development could be performed, judging from the value of the difference in whiteness.

Example 5

A binder resin composed of a mixture of polystyrene and polyester having an acid value of 10 (KOH mg/g) was used as a binding resin, which was granulated together with a charge control agent based on nigrosine to prepare a toner powder precursor. 100 parts by weight of the toner powder precursor was formed into a toner together with 0.05 part by weight of polytetrafluoroethylene fine powder and 1 part by weight of hydrophobic silica fine powder as external additives to evaluate image quality.

As a result, the difference in whiteness was 4.7, which was a value included in the permissible range.

The surface potential on the photosensitive member was scarcely lowered. However, it was considered that the difference in whiteness had the value which was barely within the permissible range probably because insufficiently controlled toner particles were increased.

Example 6

A binder resin composed of a mixture of polystyrene and polyester having an acid value of 3.7 (KOH mg/g) was used as a binding resin, which was granulated together with a charge control agent based on triphenylmethane to prepare a toner powder precursor. 100 parts by weight of the toner powder precursor was formed into a toner together with 0.05 part by weight of polytetrafluoroethylene fine powder and 1 part by weight of hydrophobic silica fine powder as external additives to evaluate image quality.

As a result, the difference in whiteness was 1.25, which was an extremely satisfactory value.

The surface potential on the photosensitive member was scarcely lowered. It was considered that appropriate development was performed.

Example 7

A binder resin composed of a mixture of polystyrene and polyester having an acid value of 1.5 (KOH mg/g) was used as a binding resin, which was granulated together with a charge control agent based on triphenylmethane to prepare a toner powder precursor. 100 parts by weight of the toner powder precursor was formed into a toner together with 2 parts by weight of polytetrafluoroethylene fine powder and 1 part by weight of hydrophobic silica fine powder as external additives to evaluate image quality.

As a result, the difference in whiteness was 1.20, which was an extremely satisfactory value.

Although the amount of the external additive was increased, the result obtained in Example 7 was not so different from the result obtained in Example 6, probably because of the following reason. Namely, the charge control agent based on triphenylmethane tends to release less electrons as compared with the charge control agent based on nigrosine. Therefore, the surface potential on the photosensitive member can be sufficiently prevented from decrease, by externally adding 0.05 part by weight of the polytetrafluoroethylene fine powder. It is considered that the effect was not improved so much even when the amount of the external additive was increased.

Next, in order to confirm the quantitative effect of the acid value of the binding resin and the quantitative effect of the external additive, toners 26 were produced in Comparative Examples (Conventional Examples). The toners 26 were measured in accordance with the same conditions as those described above to obtain results of measurement for the respective toners 26. The toners 26 concerning Comparative Examples will be explained below.

Comparative Example 1

Only a polystyrene binder resin having an acid value of not more than 1 (KOH mg/g) was used as a binding resin, which was granulated together with a charge control agent based on nigrosine, and formed into a toner together with only 1 part by weight of hydrophobic silica fine powder to evaluate image quality.

As a result, the difference in whiteness was 9.7, which was not a value included in the permissible range.

The surface potential on the photosensitive member was considerably lowered to be +500 V. This was probably because of the following reason. Namely, the surface potential on the photosensitive member was decreased due to electrons released from toner particles having a tendency to be positively charged. The force to control the toner, which would be ordinarily 300 V as the difference between the surface potential on the photosensitive member and the development bias, was a force corresponding to 100 V. As a result, it was impossible to sufficiently control the toner.

Comparative Example 2

A binder resin composed of a mixture of polystyrene and polyester having an acid value of 1.0 (KOH mg/g) was used as a binding resin, which was granulated together with a charge control agent based on nigrosine to prepare a toner powder precursor. 100 parts by weight of the toner powder precursor was formed into a toner together with 0.3 part by weight of polytetrafluoroethylene fine powder and 1 part by weight of hydrophobic silica fine powder as external additives to evaluate image quality.

As a result, the difference in whiteness was 9.2, which was not a value included in the permissible range.

The surface potential on the photosensitive member was considerably lowered to be 550 V. It was considered that the surface potential on the photosensitive member was lowered due to electrons released from toner particles having a tendency to be positively charged, and it was impossible to sufficiently control the toner.

Comparative Example 3

Only a polyester binder resin having an acid value of 30 (KOH mg/g) was used, which was granulated together with a charge control agent based on nigrosine, and formed into a toner together with only 1 part by weight of hydrophobic silica fine powder to evaluate image quality.

As a result, the difference in whiteness was 14.7, which was not a value included in the permissible range.

It is possible to avoid decrease in the surface potential of unprinted portions on the photosensitive member by incorporating, into the binding resin, the electron attractive functional group. However, it was considered that the fog was increased because insufficiently controlled toner particles such as oppositely charged toner particles were increased.

Comparative Example 4

A binder resin composed of a mixture of polystyrene and polyester having an acid value of 3.7 (KOH mg/g) was used as a binding resin, which was granulated together with a charge control agent based on nigrosine to prepare a toner powder precursor. 100 parts by weight of the toner powder precursor was formed into a toner together with 3 parts by weight of polytetrafluoroethylene fine powder and 1 part by weight of hydrophobic silica fine powder as external additives to evaluate image quality.

As a result, the difference in whiteness was 7.5, which was not a value included in the permissible range.

The surface potential of unprinted portions on the photosensitive member was prevented from decrease. However, it was considered that the fog was increased because insufficiently controlled toner particles such as oppositely charged toner particles were increased.

Comparative Example 5

A binder resin composed of a mixture of polystyrene and polyester having an acid value of 10 (KOH mg/g) was used as a binding resin, which was granulated together with a charge control agent based on nigrosine to prepare a toner powder precursor. 100 parts by weight of the toner powder precursor was formed into a toner together with 0.03 part by weight of polytetrafluoroethylene fine powder and 1 part by weight of hydrophobic silica fine powder as external additives to evaluate image quality.

As a result, the difference in whiteness was 8.3, which was not a value included in the permissible range.

The surface potential of unprinted portions on the photosensitive member was 520 V which was extremely close to the value obtained in Comparative Example 1. Accordingly, it was considered that the effect of external addition of the polytetrafluoroethylene fine powder was scarcely exhibited.

According to Examples and Comparative Examples described above, the following facts can be understood. Namely, it is possible to avoid decrease in the surface potential of unprinted portions on the photosensitive member by granulating toner particles by using the binder resin composed of the binding resin having an acid value of not less than 1.5 (KOH mg/g) and not more than 10 (KOH mg/g), and externally adding the external additive containing the electron attractive group thereto. Further, the fog phenomenon can be effectively reduced by externally adding the external additive in an amount of not less than 0.05 part by weight and not more than 2 parts by weight with respect to 100 parts by weight of the toner.

The present invention is not limited to the respective embodiments and Examples described above. It is a matter of course that various improvements and modifications can be made within a range without deviating from the gist or essential characteristics of the present invention.

For example, Examples described above have been explained by using, as the binding resin, the mixture of the polystyrene binder resin having an acid value of not more than 1 (KOH mg/g) and the polyester binder resin having an acid value of 30 (KOH mg/g). However, as described above, those usable singly or in a mixture include, for example, those obtained by adding an electron attractive group such as carboxyl group to the polystyrene binder resin, and those obtained by substituting hydrogen of terminal hydroxyl group of polar group such as carboxyl group of the polyester binder resin with methyl group or the like.

However, the acid value can be adjusted in an easier manner by mixing the resin having a relatively high acid value with the resin having a relatively low acid value as described in Examples, rather than by adjusting the acid value by means of the operation of substitution or introduction of the polar group as described above. Simultaneously, in the mixing process, it is possible to obtain the developer having arbitrary fixing property, durability, and chargeability, by making the use of the difference in characteristic such as thermal, mechanical, and electric characteristics depending on the types of the resins. Therefore, it is more preferable to adjust the acid value by mixing the resins.

In the foregoing embodiments, the toner 26 is constructed as the positively chargeable non-magnetic single-component developer. However, the toner 26 may be provided as a positively chargeable magnetic single-component developer by incorporating, as the colorant, a magnetic substance such as magnetite.

The foregoing embodiments have been explained as exemplified by the apparatus of the optical printer system based on the use of the photosensitive member, as the image-forming apparatus based on the use of the positively chargeable single-component developer of the present invention. However, the present invention is not limited thereto. The present invention may be also applied to an image-forming apparatus as disclosed in, for example, Japanese Patent Publication Nos. 4-10430 and 7-73918, in which an electrostatic latent image is formed by generating ion by using an ion source in accordance with the method of corona discharge or the like, and allowing the generated ion to selectively flow toward an electrostatic latent image carrier by using an ion flow control device comprising a plurality of ion passage control sections formed in an arrayed configuration. When the positively chargeable single-component developer of the present invention is used for such an apparatus, it is possible to obtain the effect that the electrostatic latent image is not disturbed even if the positively chargeable single-component developer contacts with the latent image carrier. Thus, it is possible to avoid fog and decrease in printing density. Japanese Patent Publication Nos. 4-10430 and 7-73918, which disclose such an image-forming apparatus, are incorporated herein by reference.

Figure 3:
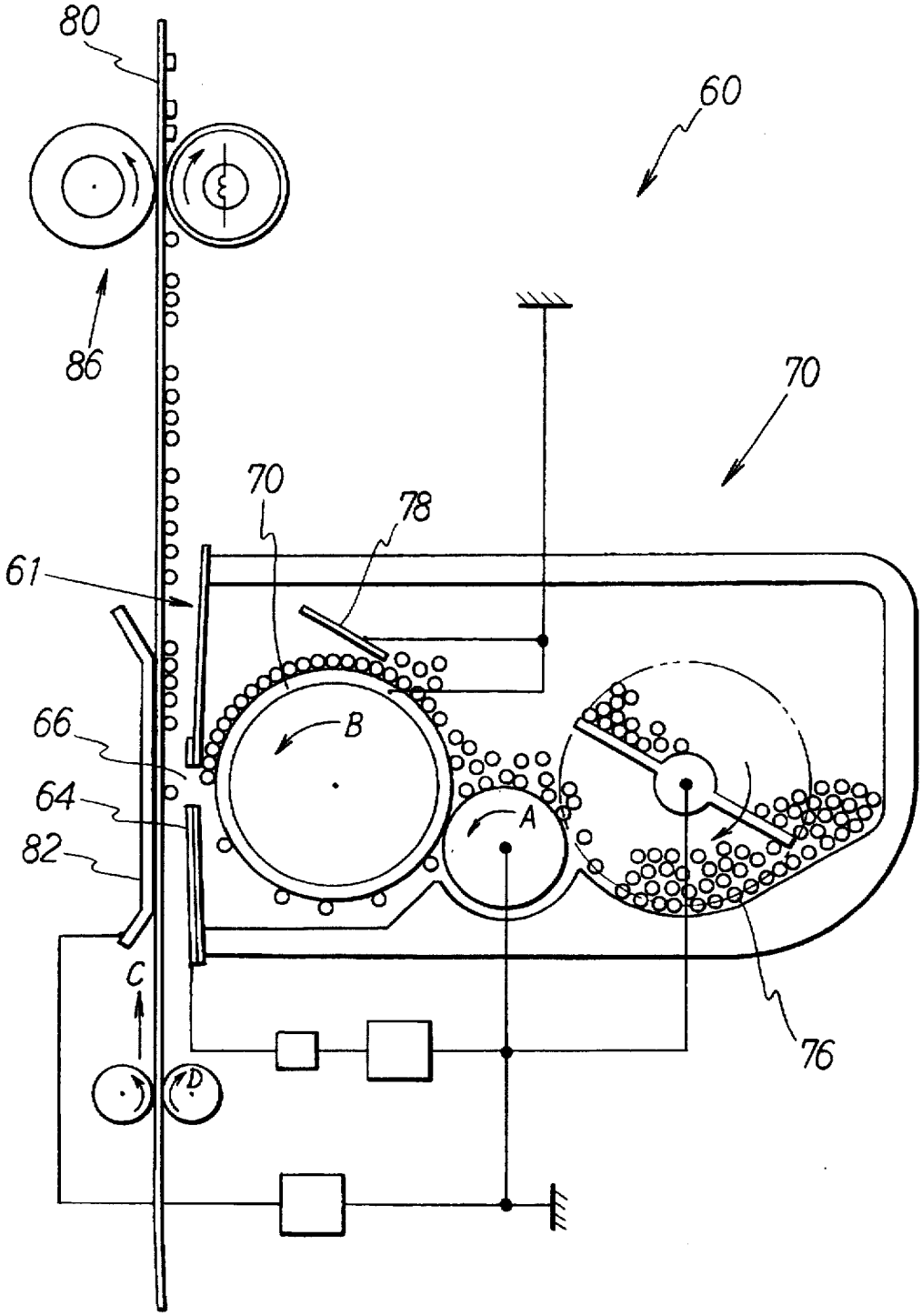
FIG. 3 shows a schematic illustration of an image-forming apparatus of the toner flow direct control system based on the use of the positively chargeable single-component developer of the present invention.
Figure 4:
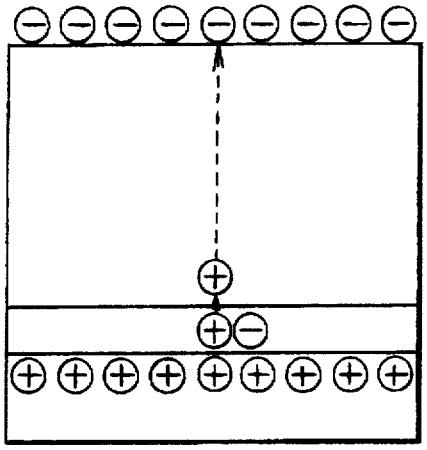
FIG. 4 shows a cross-sectional view of a negatively charging photosensitive member having a two-layer structure which is generally used.
Figure 5:
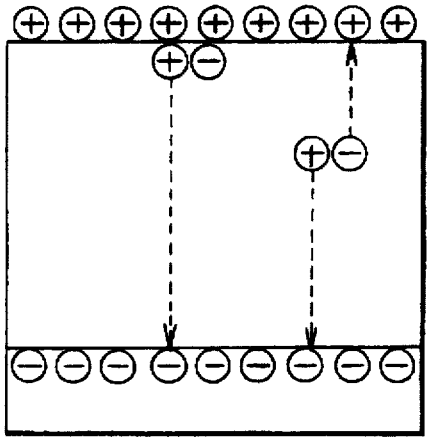
FIG. 5 shows a cross-sectional view of a positively charging photosensitive member having a single-layer structure which is generally used.
Figure 6:
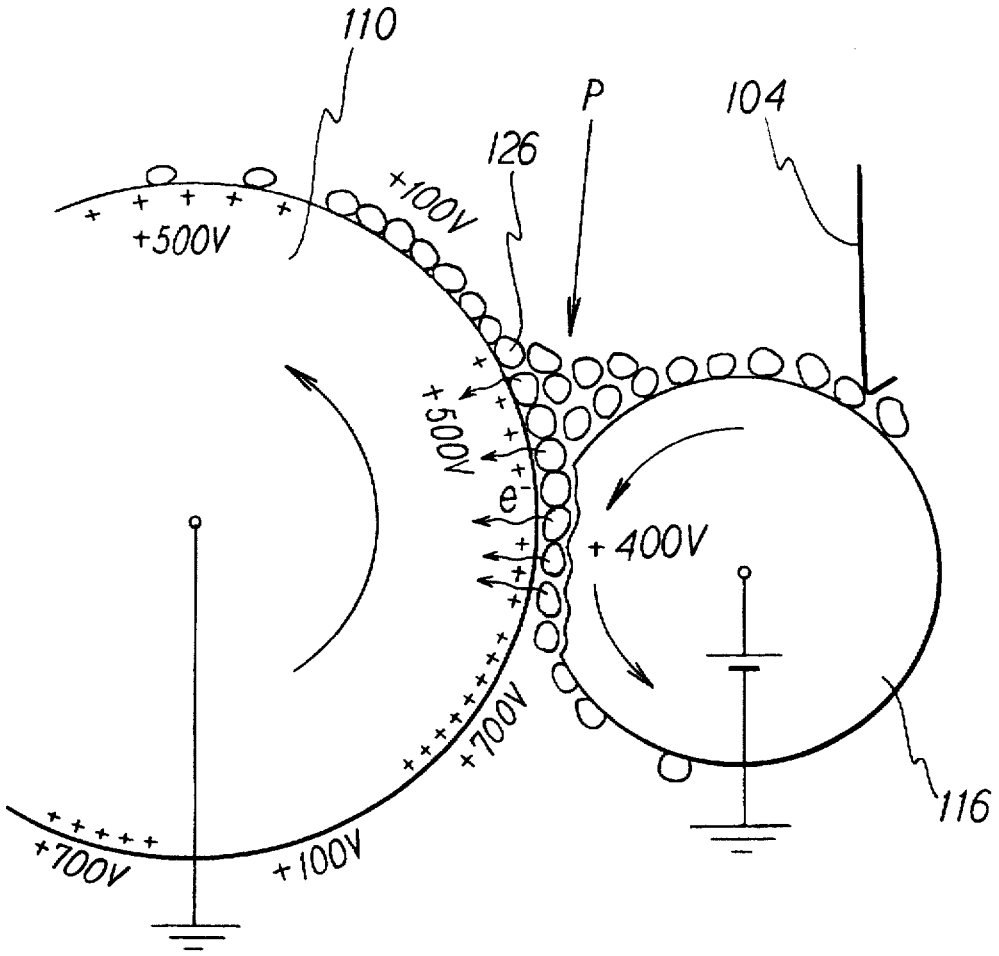
FIG. 6 illustrates a problem concerning the conventional technique.
Figure 7:
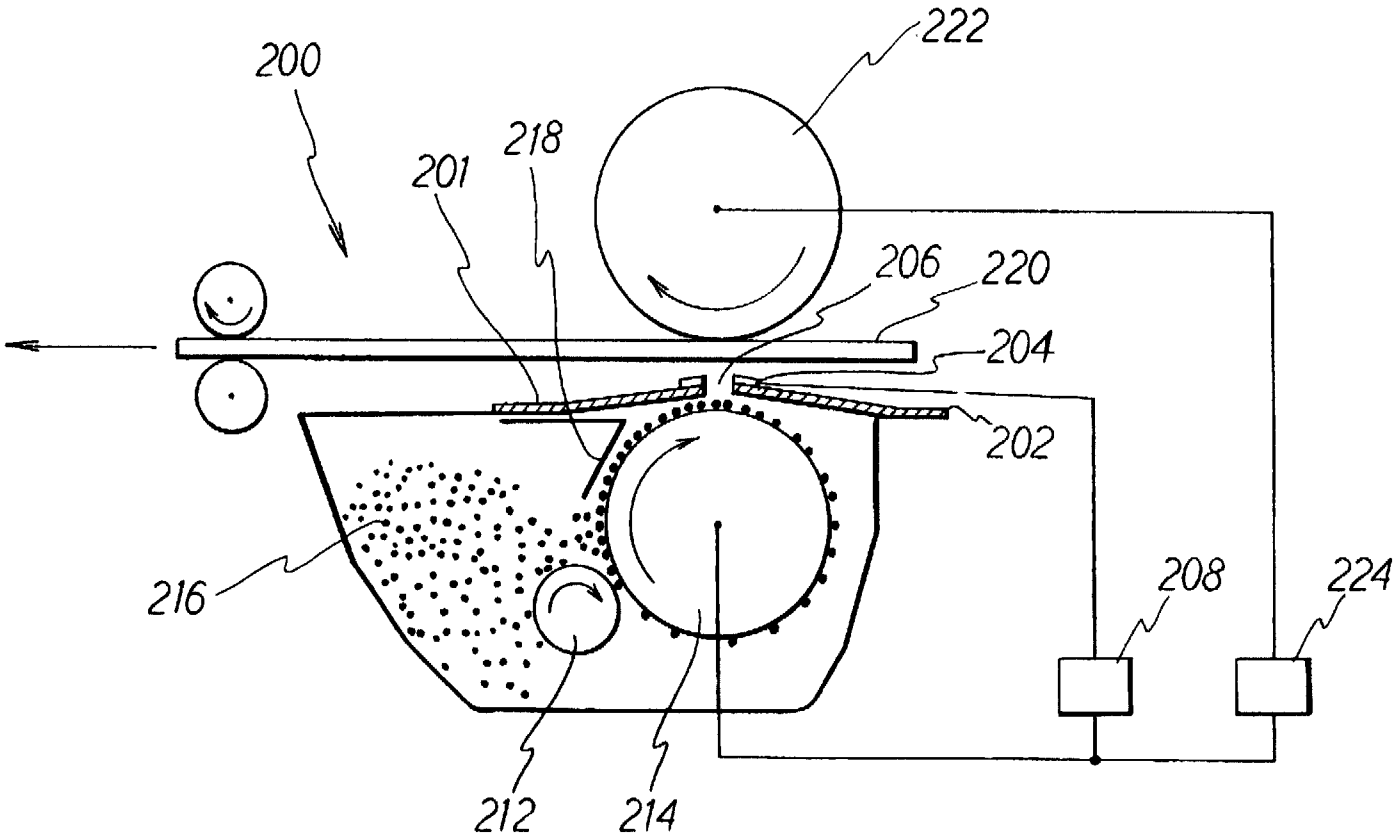
FIG. 7 schematically shows an arrangement of a conventional and general image-forming apparatus based on the toner flow direct control system.

The present invention is also applicable to an image-forming apparatus of the so-called toner flow direct control system as shown in FIG. 3 in which an image is formed by allowing toner particles to selectively flow toward an image-recording medium by using a toner flow control device comprising a plurality of toner passage control sections formed in a row. The use of the positively chargeable single-component developer of the present invention also makes it possible to improve the image quality. Such an image-forming apparatus is described in U.S. Pat. No. 5,552,814. This patent document is incorporated herein by reference.

The image-forming apparatus shown in FIG. 3 will be further explained. The image-forming apparatus 60 comprises at least a toner flow control device 61 including a toner passage section 66 formed on an insulative sheet and control electrodes 64 formed in the vicinity thereof so that passage of toner particles 76 is controlled by applying a voltage to the control electrodes 64 in accordance with an image signal; a back electrode 82 arranged on a side (i.e., on a side of the control electrodes 64) opposite to the toner flow control device 61 with an image recording medium 80 intervening therebetween, to which a high voltage of a polarity opposite to the charging polarity of the toner particles 76 is applied in order to electrostatically attract the toner particles having passed through the toner flow control device 61; a toner supply unit 70 for supplying the toner particles 76 to the toner flow control device 61; and a fixing unit 86 for fixing a toner image formed on the image-recording medium 80.

A toner-carrying roller 74, which is included in the toner supply unit 70, is pressed to contact with a surface opposite to the surface on which the control electrodes 64 of the toner flow control device 61 are formed.

The toner particles 76, which have passed through a layer-regulating member 78 and which have been adjusted for charging and conveying amounts, are carried on the toner-carrying roller 74 in accordance with the action of the electrostatic mirror force and the adhesive force such as the van der Waals force. As shown in FIG. 3, the toner particles 76 are rubbed by the toner flow control device 61 just before the toner passage section 66 so that the toner particles 76 are allowed to roll on the toner-carrying roller 74 in accordance with the mechanical action. Thus, the driving force for releasing the toner particles 76 from the mirror force and the adhesive force is given to the toner particles 76. The voltage is applied to the control electrodes 64 in accordance with the image signal. Accordingly, the toner particles 76 move from the toner-carrying roller 76, and they pass through the toner passage section 66. The toner particles 76 are attracted by the back electrode 82 so that they arrive at the image-recording medium 80, followed by being fixed by the fixing unit 86.

When the positively chargeable single-component developer of the present invention is used for the image-forming apparatus 60, electrons arerestricted to released from the toner particles 76, even if the toner particles 76 are frictionally charged by the contact between the toner particles 76 and the insulative sheet of the toner flow control device 61. Therefore, it is possible to avoid occurrence of the problem that the image formation would be badly affected by toner particles 76 allowed to adhere to the foregoing portion and then interfere toner particles 76 supplied thereafter.

As clarified from the foregoing explanation, the positively chargeable single-component developer of the present invention functions as follows. Namely, the operating member such as the photosensitive member and the toner flow control device to serve as an electrostatic latent image carrier for carrying an electrostatically formed image, with which the positively chargeable single-component developer of the present invention contacts upon printing, does not suffer any change in surface potential which would be otherwise changed by electrons released from any other conventional positively chargeable single-component developer since such a positively chargeable single-component developer is frictionally charged again upon contact with the operating member. Therefore, for example, the surface potential of unexposed portions on the photosensitive member is prevented from decrease so that the problem of fog is solved, and the surface of the toner flow control device is prevented from adhesion of toner particles caused by accumulation of charge so that the problems of aperture clogging and faint print are solved. Thus, it is possible to provide an extremely excellent image quality.

The positively chargeable single-component developer of the present invention is based on the use of the binding resin obtained by mixing at least the first resin having a relatively low acid value and the second resin having a relatively high acid value. Thus, it is extremely easy to prepare the binding resin having an arbitrary acid value in the range from 1.5 to 10 (KOH mg/g). More preferably, it is possible to obtain the developer having arbitrary fixing property, durability, and chargeability, by making the use of characteristics such as thermal, mechanical, and electric characteristics inherently possessed by the two resins.

The positively chargeable single-component developer of the present invention is based on the use of the triphenylmethane compound or the nigrosine compound as the charge control agent. Accordingly, electrons, which are released by insufficiently charged developer particles upon recharging, can be collected before they are transmitted to the electrostatic latent image carrier or other components. Therefore, the positively chargeable single-component developer is stably charged, and it is possible to obtain an image having higher image quality.

The image-forming apparatus of the present invention is arranged such that the electrostatic latent image carrier for carrying an electrostatic latent image on its surface contacts with the developer-conveying member for conveying the positively chargeable single-component developer to the electrostatic latent image in order to visualize the electrostatic latent image. Even when the electrostatic latent image carrier and the developer-conveying member are moved in mutually opposite directions, the use of the positively chargeable single-component developer of the present invention makes it possible to form a good image without disturbing the electrostatic latent image, and increase the degree of freedom upon design of the image-forming apparatus.

The foregoing advantage is obtained because of the following reason. Namely, even when the photosensitive member as the electrostatic latent image carrier contacts with the developing roller as the developer-conveying member in a counter manner, and the toner pool is produced at the contact portion, then the use of the positively chargeable single-component developer of the present invention avoids decrease in the surface potential of unexposed portions on the photosensitive member, and makes it possible to control the developer in accordance with the development bias. Accordingly, the effect is obtained in that any fog can be reliably avoided even when the image-forming apparatus of the so-called counter contact type is used. Therefore, it is unnecessary to provide a special arrangement for removing the toner pool by the aid of the gravity. As a result, any restraining condition on design disappears concerning the contact condition between the electrostatic latent image carrier and the developer-conveying member.

The present invention may be practiced or embodied in other various forms without departing from the spirit or essential characteristics thereof. It will be understood that the scope of the present invention is indicated by the appended claims, and all variations and modifications concerning, for example, the type or form of the binding resin having the specified acid value, the method for adjusting the acid value, and the type or system of the image-forming apparatus based on the use of the developer of the present invention, which come within the equivalent range of the claims, are embraced in the scope of the present invention.

What is claimed is:

1. A positively chargeable single-component developer for visualizing electrostatic latent images, comprising:

a binding resin having an acid value of 1.5 to 10 (KOH mg/g);

a colorant; and an additive having an electron attractive group, wherein;

the additive is added in an amount of 0.05 part by weight to 2 parts by weight with respect to 100 parts by weight of the positively chargeable single-component developer.

2. The positively chargeable single-component developer according to claim 1, wherein the binding resin is a mixed resin composed of a first resin having a relatively low acid value and a second resin having a relatively high acid value, and the acid value of the binding resin is adjusted to be 1.5 to 10 (KOH mg/g) by mixing the first and second resins.

3. The positively chargeable single-component developer according to claim 2, wherein the binding resin is a mixed resin composed of a polystyrene binder resin and a polyester binder resin.

4. The positively chargeable single-component developer according to claim 1, wherein the acid value of the binding resin is adjusted by at least one of introduction of a polar group exhibiting acidity into the resin, and substitution of hydrogen of an acidic group with a substituent.

5. The positively chargeable single-component developer according to claim 4, wherein the polar group exhibiting acidity is a carboxyl group.

6. The positively chargeable single-component developer according to claim 1, further comprising a charge control agent.

7. The positively chargeable single-component developer according to claim 6, wherein the charge control agent is at least one of a triphenylmethane compound and a nigrosine compound.

8. The positively chargeable single-component developer according to claim 1, wherein the binding resin is at least one resin selected from the group consisting of polystyrene resin, polyacrylate resin, polymethacrylate resin, polyvinyl resin, polyester resin, polyethylene resin, polypropylene resin, polyvinyl chloride, polyether resin, polycarbonate resin, polycellulose resin, polyamide resin, and copolymers containing a monomer for constructing the resins.

9. The positively chargeable single-component developer according to claim 1, wherein the additive having the electron attractive group is at least one additive selected from the group consisting of polyfluoroethylene fine powder, polyfluorovinylidene fine powder, polychloroethylene fine powder, polychlorovinylidene fine powder, polybromoethylene fine powder, polybromovinylidene fine powder, and polyester fine powder.

10. The positively chargeable single-component developer according to claim 1, wherein the colorant is carbon black.

11. The positively chargeable single-component developer according to claim 1, further comprising a magnetic substance.

12. An image-forming apparatus comprising:

an electrostatic latent image carrier for carrying an electrostatic latent image on its surface; and a developer-conveying member arranged in contact with the latent image carrier, for conveying a developer to the electrostatic latent image on the electrostatic latent image carrier, wherein;

the developer is a positively chargeable single-component developer comprising a binding resin having an acid value of 1.5 to 10 (KOH mg/g), a colorant, and an additive having an electron attractive group, and the additive is added in an amount of 0.05 part by weight to 2 parts by weight with respect to 100 parts by weight of the positively chargeable single-component developer.

13. The image-forming apparatus according to claim 12, wherein the electrostatic latent image carrier and the developer-conveying member are moved in mutually opposite directions at a contact position between the electrostatic latent image carrier and the developer-conveying member.

14. The image-forming apparatus according to claim 13, wherein the electrostatic latent image carrier is a photosensitive member-equipped roller, the developer-conveying member is a developing roller, and the rollers are moved in opposite directions at a nip formed by contact between the photosensitive member-equipped roller and the developing roller.

15. The image-forming apparatus according to claim 12, wherein the electrostatic latent image carrier is a photosensitive member-equipped roller, the developer-conveying member is a developing roller, the photosensitive member-equipped roller and the developing roller are moved in an identical direction at a nip formed by contact between the photosensitive member-equipped roller and the developing roller, and the photosensitive member-equipped roller and the developing roller are moved at mutually different velocities.

16. The image-forming apparatus according to claim 12, wherein the apparatus is an optical printer.

17. The image-forming apparatus according to claim 12, wherein the apparatus is an image-forming apparatus based on the toner flow direct control system.

18. The image-forming apparatus according to claim 12, wherein the apparatus is an image-forming apparatus for forming the electrostatic latent image by allowing ion to flow toward the electrostatic latent image carrier by using an ion flow control device.

19. The image-forming apparatus according to claim 14, wherein the binding resin is a mixed resin composed of a first resin having a relatively low acid value and a second resin having a relatively high acid value, and the acid value of the binding resin is adjusted to be 1.5 to 10 (KOH mg/g) by mixing the first and second resins.

20. The image-forming apparatus according to claim 14, wherein the binding resin is a mixed resin composed of a polystyrene binder resin and a polyester binder resin.

* * * * *